US005141120A

United States Patent [19]

Brown et al.

[11] Patent Number: 5,141,120

[45] Date of Patent: Aug. 25, 1992

[54] HOT FILL PLASTIC CONTAINER WITH VACUUM COLLAPSE PINCH GRIP INDENTATIONS

[75] Inventors: Randall S. Brown, Adrian; Len Zabinko; Veigh Nielson, both of Ann Arbor; George Pinter, South Lyon; Dennis Spina, Onsted, all of Mich.

[73] Assignee: Hoover Universal, Inc., Plymouth, Mich.

[21] Appl. No.: 663,165

[22] Filed: Mar. 1, 1991

[51] Int. Cl.[5] ..... B65D 1/02; B65D 23/00; B65D 23/10

[52] U.S. Cl. ..... 215/1 C; 215/100 A; 220/609; 220/675; 220/771

[58] Field of Search ..... 215/1 C, 100 A, 1 R; 220/94 A, 94 R, 609, 675, 666; D9/376, 378, 408

[56] References Cited

U.S. PATENT DOCUMENTS

| | | | |
|---|---|---|---|
| 4,381,061 | 4/1983 | Cerny et al. | 220/609 X |
| 4,804,097 | 2/1989 | Alberghini et al. | 215/1 C X |
| 4,805,788 | 2/1989 | Akiho | 215/1 C |
| 4,863,046 | 9/1989 | Collette et al. | 215/1 C |
| 4,877,141 | 10/1989 | Hayashi et al. | 215/1 C |
| 4,890,752 | 1/1990 | Ota et al. | 215/100 A X |
| 5,054,632 | 10/1991 | Alberghini et al. | 220/609 X |

FOREIGN PATENT DOCUMENTS

| | | | |
|---|---|---|---|
| 90987 | 3/1968 | France | 215/1 C |
| 7126310 | 8/1962 | Japan | 215/1 R |
| 2218395 | 11/1989 | United Kingdom | 215/1 C |

*Primary Examiner*—Sue A. Weaver
*Attorney, Agent, or Firm*—Harness, Dickey & Pierce

[57] ABSTRACT

A hot-fill PET container which includes opposed pinch grip indentations in the sidewall enabling the container to be grasped between the thumb and fingers of one hand to facilitate handling of the container and pouring of liquid from the container. Each indentation comprises an irregularly shaped surface having an outside edge and an integral hinge enabling the indentations to collapse inwardly toward each other to accommodate internal forces tending to collapse the container sidewall inwardly due to filling of the container with liquid at an elevated temperature and subsequent cooling of the liquid.

3 Claims, 3 Drawing Sheets

HOT FILL PLASTIC CONTAINER WITH VACUUM COLLAPSE PINCH GRIP INDENTATIONS

BACKGROUND AND SUMMARY OF THE INVENTION

This invention relates generally to hot-fill polyester containers and more particularly to a PET container of this type provided with vacuum collapse pinch grip indentations.

Thin walled thermoplastic polymeric containers of bottle shape are becoming increasingly recognized as desirable for containing liquids such as processed fruit juices and the like which must be pasteurized and as a result, are placed in the container when hot, namely, above about 180° F. Accordingly, such a container must be of the "hot-fill" type. Hot-fill PET containers are well known and are shown in U.S. Pat. Nos. 4,805,788 and 4,863,046. Such containers are characterized by the fact they are made of a heat set material such as PET with 28-32% crystalinity and they accommodate hot filling and partial evacuation without adverse affects on their appearance. Other hot-fill containers are illustrated in earlier filed U.S. patent application Ser. Nos. 211,464, 452,638 and 492,073 owned by the assignee of this application.

These containers are formed by blow molding biaxially orientable polyethylene terephthalate (PET) resin. The result is containers which have a number of advantages such as being lightweight, having excellent mechanical strength and physical properties and being inexpensive in cost together with the ability to be produced in large numbers.

Because of the lightweight, thin-walled characteristics of such containers, they can be made in large sizes and still be manually handled during storage and dispensing without undue manual effort.

However, the hot-fill containers presently in use have the main sidewall portion of the container of generally tubular shape and are provided with upright side panels which will tend to collapse inwardly after the hot liquid is dispensed into the container so as to accommodate the inevitable volume shrinkage of the liquid in the bottle. As a result, while the containers may be readily carried and tipped for pouring, two hands are often required because of the large diameter of the sidewall portion and the difficulty of gripping the sidewall portion with one hand.

Accordingly, it is the principal object of this invention to provide an improved hot-fill container of the above type having an opposed pair of indentations in the sidewall portion enabling the sidewall portion of the container to the grasped between the thumb and fingers of one hand to thereby enable one handed lifting and manipulation of the container.

It is further object of this invention to provide for hinging support of the pair of indentations on the sidewall portion to thereby enable the indentations to collapse inwardly toward each other to accommodate internal forces tending to collapse the sidewall portion inwardly due to filling of the container with liquid at an elevated temperature and subsequent cooling of the liquid.

U.S. Pat. Nos. 4,804,097 and 4,897,052 show PET containers with hand grip indentations in the side walls. However, the containers in which the hand grip indentations are embodied are not hot-fill containers. They are conventional PET containers for liquor, soft drinks, or the like which cannot withstand being filled with liquid at an elevated temperature. Thus, the present invention utilizes the desirable characteristics of the prior art hot-fill containers and embodies in these containers the pinch grip indentations in the form of vacuum collapse panels which can collapse inwardly of the container due to filling of the container with liquid at an elevated temperature and subsequent cooling of that liquid.

Further objects, features and advantages of the invention will become apparent from a consideration of the following description, the appended claims and the accompanying drawing.

DETAILED DESCRIPTION OF THE DRAWING

Figure 1:
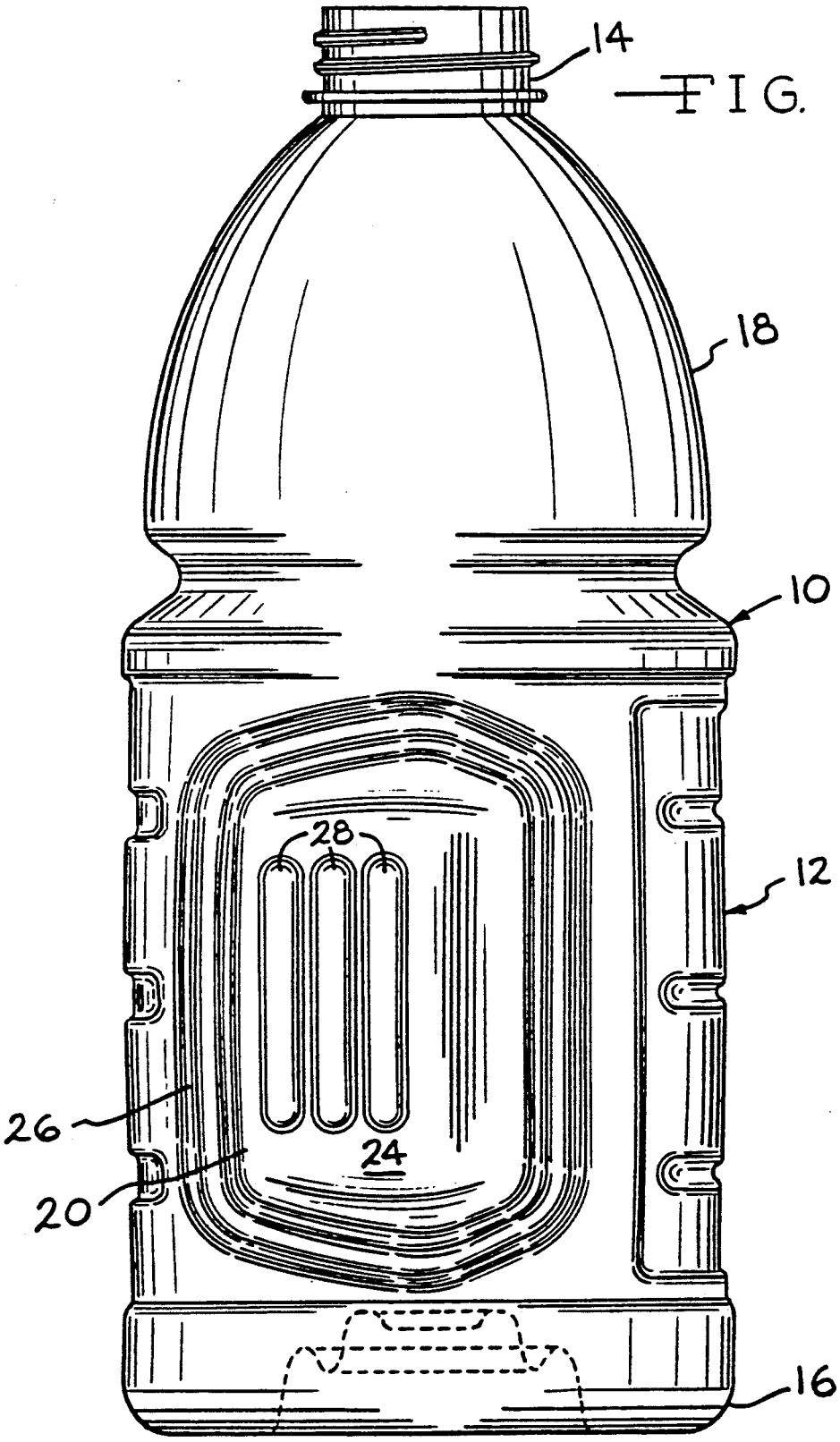
FIG. 1 is a side elevational view of the container of this invention, showing one of the pinch grip indentations in the container in elevation.

With reference to the drawing, the container of this invention, indicated generally at 10, is illustrated in FIG. 1 as having a main sidewall portion 12 of generally round cylindrical shape, an upper portion 14 defining a sealable closure, and a base portion 16. A generally dome shape portion 18 is located between the sidewall portion 12 and the closure 14.

The container 10 is a "hot-fill" container which is formed in a blow mold of a heat set material such as PET. The sidewall portion 12 includes an opposed pair of indentations 20 enabling the sidewall portion 12 to be grasped between the thumb and fingers of one hand, the indentations 20 each comprising a large irregularly shaped surface 24 bounded by an outside edge strip 26. As clearly seen in FIGS. 2 and 3, the indentations 20 form substantial deviations from the surface sidewall portions 12 into the container 10.

Figure 3:
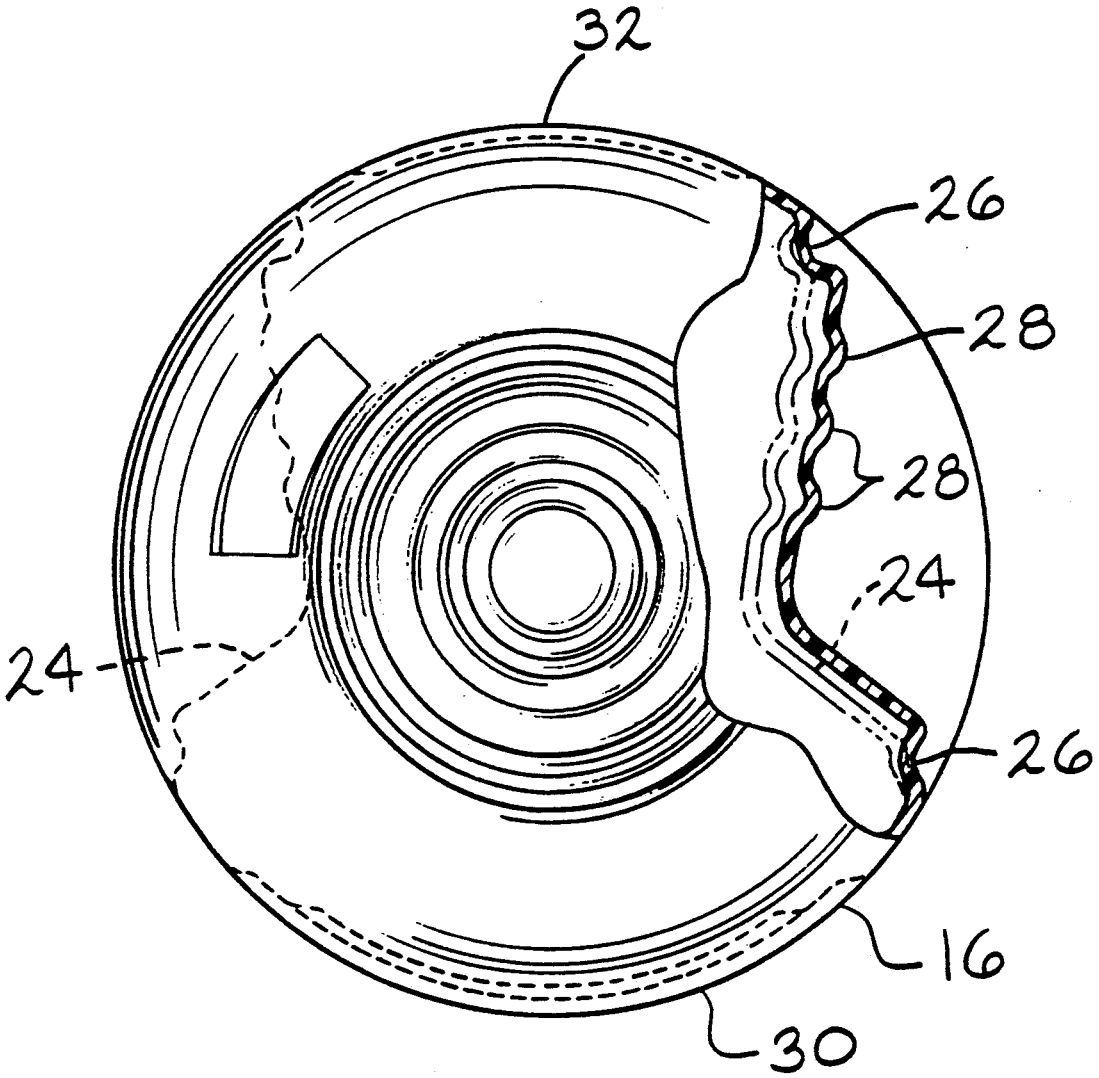
FIG. 3 is a bottom view of the container of this invention with some parts broken away and other parts shown in section to illustrate the cross-sectional configuration of a pinch grip indentation, showing in broken lines the collapsed position of the indentation.

As best appears in FIG. 3, each strip 26 is of a curved shape in cross-section so that it is concave in a direction axially inwardly of the container 10 for a purpose to appear presently.

Each of said intended surfaces 24 also includes a plurality of horizontally spaced upright anti-slip finger grips 28 each of which also forms an upright stiffener rib in the surface 24. As a result, each of the grips 28 is convex in a direction outward of the container 10.

In use of the container 10, the container is filled with a hot liquid and when the liquid cools, the indentation surfaces will collapse inwardly, as shown in broken lines in FIG. 3 so as to accommodate the resulting shrinkage in volume of the fluid in the container as it cools. The result will be a container in which the fill line is at the desired level in the container after the liquid has cooled and the appearance of the container 10 is not significantly affected.

A user of the container 10, desiring to lift the container, either for transport purposes or for tipping to discharge the contents, will position his/her hands about the sidewall portion 12 so that the thumb is engaged with one of the indentations 20 and the forefingers are engaged with the other indentation 20. The hand grips 28 facilitate such engagement and ensure against inadvertent slipping. It is to be noted that there are diametrically opposite sidewall sections 30 and 32 in the sidewall portion that are positioned between the indentations 20. A plurality of generally horizontally stiffening ribs 34 are formed in the sidewall sections 30 and 32 to insure the generally cylindrical shape. The user's hand can be positioned on the indentations 20 so that either of the sections 30 or 32 is straddled between the thumb and forefingers of the hand.

Figure 2:
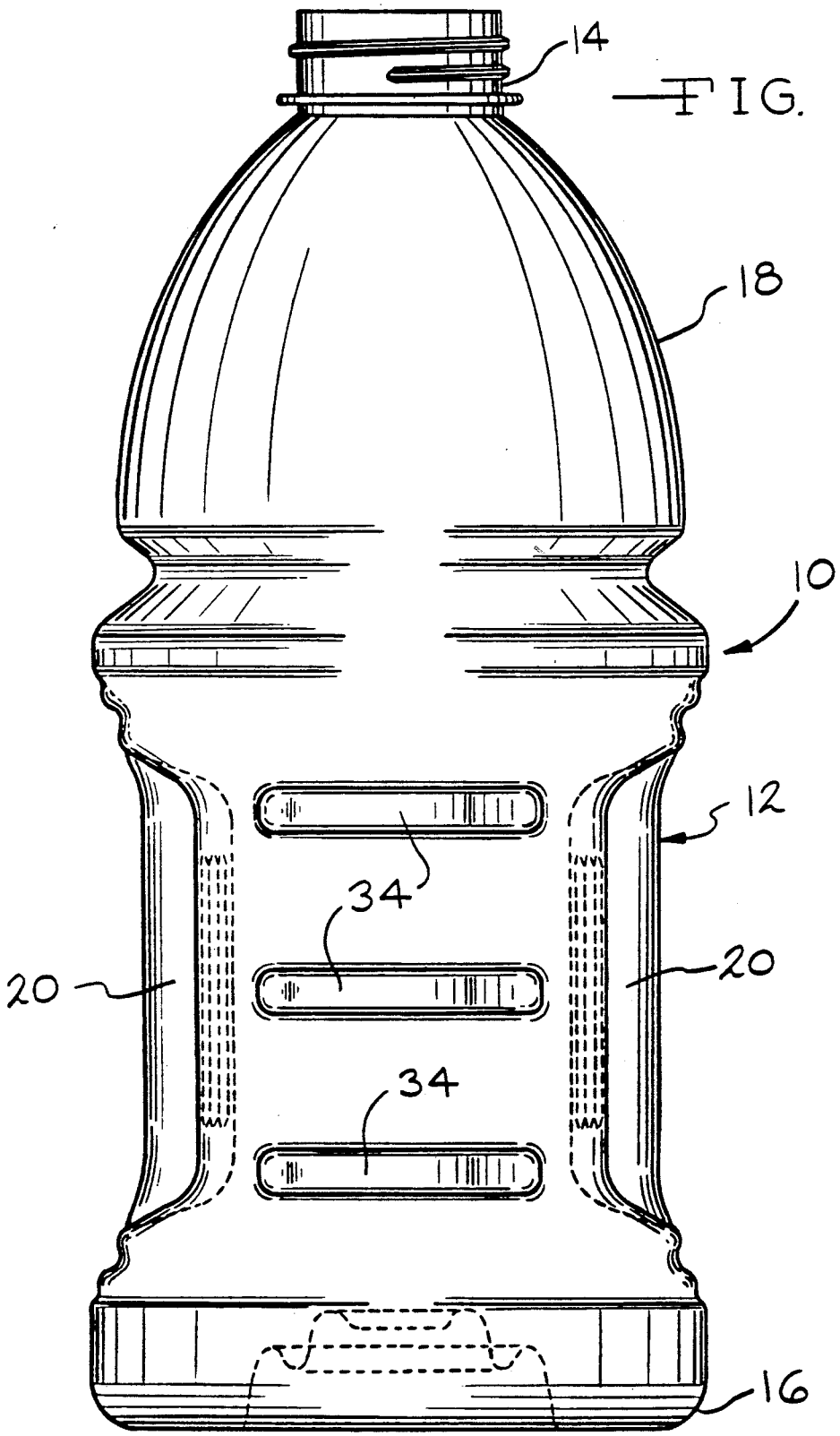
FIG. 2 is another side elevational view of the container of this invention showing the pinch grip indentations on diametrically opposite sides of the container.

From the above description it is seen that this invention provides a hot-fill container in which handling of the container for either transport or pouring purposes is facilitated by the provision of hand grip indentations 20 in diametrically opposite sections of the sidewall portion 12 of the container. As shown in FIGS. 1 and 2, each strip 26 is continuous and endless with rounded corners, as contrasted to sharp substantially right angle corners, to facilitate unrestricted inward movement of the indentations 20 toward each other, the concave cross-sectional shape of the strips 26 further enabling unrestricted movement of the indentations 20. These hand grip indentations are also operable to form the necessary collapse panels in the hot-fill container 10 by virtue of their mounting on the hinge strips 26 which facilitate inward collapse of the indentations 20.

We claim:

1. A thin-walled plastic container formed by blow molding and adapted to be filled with liquid at a temperature elevated above room temperature, said container comprising an upper portion which includes a sealable closure, a lower base portion closing the bottom of the container and a sidewall portion of generally tubular shape formed integral with and extending between said upper and lower portions, said sidewall portion including an opposed pair of indentations being substantial deviations into the container from the generally tubular shape of the sidewall portion and enabling the sidewall portion to be grasped between the thumb and fingers of one hand, the indentations each comprising an irregularly shaped surface having an outside edge which is continuous and endless and without sharp corners, and hinge means connected to and extending between said outside edge and said sidewall portion to thereby enable said indentations to collapse inwardly toward each other to accommodate internal forces tending to collapse said sidewall portion inwardly due to filling of the container with liquid at an elevated temperature and subsequent cooling of the liquid, said hinge means being continuous and endless and comprising narrow strips of plastic in said sidewall which are of curved shape in transverse cross section and are formed integral with said outside edge and said sidewall.

2. The container according to claim 1 wherein said strips are curved so as to be concave in a direction inwardly of said container.

3. The container according to claim 1 wherein each of said indentation surfaces has a plurality of generally upright anti-slip finger grips arranged side by side, each of said grips being convex in direction outwardly of said container.

* * * * *